US005310483A

United States Patent [19]

Hammerschmitt

[11] Patent Number: 5,310,483

[45] Date of Patent: May 10, 1994

[54] SEPARATOR VESSEL

[76] Inventor: Nikolaus Hammerschmitt, Kölner Strasse 138, 5350 Euskirchen, Fed. Rep. of Germany

[21] Appl. No.: 902,648

[22] Filed: Jun. 22, 1992

[30] Foreign Application Priority Data

Jun. 22, 1991 [DE] Fed. Rep. of Germany ..... 4120712

[51] Int. Cl.[5] ..... E02B 15/04

[52] U.S. Cl. ..... 210/242.3; 210/521; 210/540; 210/923

[58] Field of Search ..... 210/242.3, 923, 170, 210/257.1, 258, 259, 521, 538, 540

[56] References Cited

U.S. PATENT DOCUMENTS

| | | | |
|---|---|---|---|
| 2,876,903 | 3/1959 | Lee | 210/242.3 |
| 3,219,190 | 11/1965 | Thune | 210/242.3 |
| 3,237,774 | 3/1966 | Schuback | 210/242.3 |
| 3,708,070 | 1/1973 | Bell | 210/242.3 |
| 3,847,816 | 11/1974 | DiPerna | 210/923 |
| 3,849,311 | 11/1974 | Jakubek | 210/521 |
| 3,966,614 | 6/1976 | Ayers | 210/923 |
| 3,983,034 | 9/1976 | Wilson | 210/923 |
| 4,146,482 | 3/1979 | Shyu | 210/923 |
| 4,271,017 | 6/1981 | Milgram | 210/923 |
| 4,372,854 | 2/1983 | Szereday | 210/923 |
| 4,595,510 | 6/1986 | Winbladh et al. | 210/923 |
| 4,963,272 | 10/1990 | Garrett | 210/242.3 |

*Primary Examiner*—Christopher Upton
*Attorney, Agent, or Firm*—Herbert Dubno; Henri Kateshou

[57] ABSTRACT

A vessel for the takeup of light liquid floating on the water surface and a corresponding mother vessel has at least one air-filled cavity which is adapted to be filled or discharged with water for the adjustment of the draught, a light liquid receiving assembly located at the front vessel part and a light liquid receiving, the light liquid receiving room communications with the outside water so that the received light liquid progressively displaces the water in the light liquid receiving room.

13 Claims, 9 Drawing Sheets

SEPARATOR VESSEL

FIELD OF THE INVENTION

The present invention is directed to a vessel for taking up light liquid located on the water surface and including at least one air-filled cavity which is adapted to be filled or discharged with water for the adjustment of the draught, a light liquid receiving device located at the forward portion of the vessel and a light liquid receiving room.

BACKGROUND OF THE INVENTION

As a result of increasingly dangerous oil spilled accidents with tankers large amounts of the light liquid transported by the tanker, especially crude oil, spread on the sea or on corresponding inland waters. Normally, these light liquid amounts have to be very quickly removed in order to avoid greater environmental damages, for example a contamination of bank portions and beaches, by the light liquid layer.

OBJECT OF THE INVENTION

It is therefore an object of the invention to provide a vessel with which especially large amounts of light liquid can be taken up in a simple and fast manner under the simultaneous separation of the received light liquid/heavy liquid mixture.

SUMMARY OF THE INVENTION

According to the invention this problem is solved with a vessel having the light liquid receiving in communication with the outside water and the draught adjusted such that the water level is in the light liquid receiving room at the beginning of the light liquid takeup, the light liquid receiving means comprising a knife-like member grasping under the light liquid layer to be taken up and a joining upwardly directed inclined plane, the inclined plane extends to at least one light liquid inlet into the light liquid receiving room located above the outside water level and provided with a joining dip well or dip tube.

In operation the takeup vessel according to the invention grasps with the knife-like member located under the light liquid layer which has to be taken up and which is banked-up by the relative speed between the vessel and the layer to be taken up therefore directing the layer upwardly to the light liquid inlet along the inclined plane. The arriving light liquid which still contains a relatively low portion of heavy liquid water enters the dip well or the dip tube extending into the light liquid receiving room for substantially filling the room with water displacing successively the water contained previously in the light liquid receiving room. This is achieved by the fact that the light liquid receiving room is in communication with the outside water so that the light liquid receiving room is continuously receiving the light liquid directed by the knife member. If a predetermined filling ratio is reached, the light liquid can be pumped off from the light liquid receiving room whereby the light liquid receiving room is again filled with water.

At the beginning of the light liquid takeup the height of the water level in the light liquid receiving room can be adjusted by corresponding flooding of the at least one air-filled cavity. Furthermore, these cavities serve for balancing the weight of the vessel and make the same buoyant. They are also used for the stabilization of the vessel construction.

The adjustment of the draught which has once been made does not change during the operation of the vessel, even at the maximum filling ratio of the light liquid receiving room by the light liquid, since the light liquid which was taken up floats up on the displaced water level. Preferably, a pressure balance opening serves for the communication of the light liquid receiving room with the outside water.

In the light liquid receiving room a separation of the light liquid from the entrained water occurs. Then, the light liquid can be pumped off from the light liquid receiving room in a water-free manner, for example by the provision of a suction container connected to the receiving room at the height of the outer water level. The content of the light liquid receiving room is lifted by the displaced water level in correspondence with the pump volume so that, in spite of the higher located suction height, a complete water-free discharge is enabled. Mother vessels with installed tanks are suited for the final disposal of the light liquid pumped off, or, for example, a refilling can be realized ashore.

The dip well or the dip tube extend up to the lower portion of the light liquid receiving room so that the light liquid-water-mixture introduced through the dip well or the dip tube is passed through the water located within the light liquid receiving room, whereby a separation of the mixture occurs and the light liquid ascends in the light liquid receiving room. By this, an especially good separation effect between the light liquid and the water is obtained.

According to an other feature of the invention the light liquid receiving room is in communication with a light liquid suction room located slightly below the outside water level. This light liquid suction room is downwardly open and has a lateral downwardly directed opening which is exactly aligned with the water level. By this, the evacuation of water is prevented.

Conveniently, the knife-like member is pivotally located at the lowest point of the inclined plane. Thus the knife-like member can be adjusted differently high in accordance with the thickness of the light liquid layer. This feature secures a good adaption to the existing light liquid layer, whereby the entraining of great amounts of water into the light liquid receiving room is prevented.

Preferably, the draught is adjusted in such a manner that the outside water level and the inside water level are at the height of the support point of the knife-like member at the beginning of the light liquid takeup. In this case, the light liquid layer can be grasped under very well according to a planing tool, and the light liquid layer stands immediately at the inclined plane extending to the light liquid inlet.

Furthermore, the draught is preferably adjusted such that, at the beginning of the light liquid takeup, the outside water level and the inside water level are at a level corresponding to 85% of the length of the dip well or the dip tube. This adjustment is selected in adaption to a light liquid density of 0.85 g/cm$^3$ so that 85% of the dip well or of the dip tube in the light liquid receiving room are under the original water level in the light liquid receiving room and 15% are above the same.

Preferably air-filled cavities are located at the two longitudinal sides of the vessel, wherein the light liquid receiving means is located therebetween. According to an improvement the air-filled cavities project forwardly beyond the light liquid receiving means and are formed in a knife-edge-like manner. By this measure it is attained that the light liquid floating on the water is caught between the projecting cavities so that a desired banking-up effect results which promotes the transport of the light liquid to the light liquid inlet.

Furthermore, the inventive vessel is preferably designed such that the air-filled cavities project upwardly beyond the level of the light liquid inlet and form a light liquid retaining trough. Conveniently, a dip well is arranged in the forward portion and a dip tube is arranged in the rearward portion. Both extend into the light liquid receiving room and emanate from the light liquid retaining trough. By this, on the one side the light liquid-water-mixture flowing upwardly the inclined plane is entrapped so that it can flow to the dip well by means of the light liquid inlet. On the other side, the part of the mixture overflowing the inlet or the dip well is also discharged into the light liquid receiving room by means of the dip tube provided in the rearward portion.

Appropriately, the dip well has a front well wall and rear well wall extending over the complete width of the light liquid receiving room. By this, the mixture is introduced over the whole width of the light liquid receiving room, whereby a uniform separation effect is obtained. Preferably, the rear well wall extends upwardly beyond the inlet and forms thereby a front boundary wall for the light liquid retaining trough. Accordingly, if a very high amount of mixture flows to the inlet at once the rear well is overflow. The portion of the mixture entering the trough is discharged into the light liquid receiving room by means of the additional dip tube.

Accordingly, the vessel functions in a very simple manner. The operation by one person is sufficient. A reception ability up to about 10 $m^3$ has shown favourable results. The vessel can have a lightweight construction. With the provided construction a small speed of about 5–6 km/h is sufficient in order to obtain the necessary bank-up of the light liquid between the outer walls of the vessel. So, for example, with a density of the light liquid of 0.90 $g/cm^3$ a bank-up of 10 cm is sufficient in order to fill an effective room of a height of 1 m.

If necessary, the above-described vessel can be also used for greater oil accidents in connection with container vessels or pushboats. Several adjacent vessels with own drive means connected with one another are appropriate, for example, with three or four vessels the respective outer vessels are driven. With vessels connected with side by side barriers can be generated which can take up oil flowing over a large surface.

The construction of the vessel enables the reception of any layers of light liquid, such as oil, to be flown out. The final separation of water and light liquid occurs within the interior of the vessel and does in no manner influence the draught of the swimming vessel. Furthermore, thereby the static advantage is used for the construction. The correct passage is obtained alone by the speed of the movement of the vessel. The use of a light liquid suction room or suction container at the water level enables an evacuation of the whole content.

Furthermore, the present invention is directed to a mother vessel for takeup of the light liquid pumped off by a vessel according to the invention. According to the invention such a mother vessel has also at least one light liquid receiving room in communication with the outside water into which at least one dip well or dip tube for the light liquid to be introduced opens, wherein a fine separation stage is located in the lower portion of the light liquid receiving room, the communication with the outside water being under the fine separation stage.

Accordingly, such a mother vessel is based on a corresponding principle as the above-described vessel. The light liquid pumped off by the vessel is introduced by means of the dip well or the dip tube into the lower portion of the at least one light liquid receiving room. Since this room is also filled with water, the introduced light liquid displaces the water. Remaining water which is still entrained in the introduced mixture is thus separated from the light liquid. The slight emulsification generated by the use of pumps requires a fine separation which is provided in the lower portion of the light liquid receiving room. Appropriately, the fine separation stage includes a separation chamber system with inclined planes and heavy liquid passage openings at the bottom. The communication with the outside water is provided below the fine separation stage. Accordingly, substantially pure light liquid collects in the light liquid receiving room. This can be used again or led away for final disposal.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
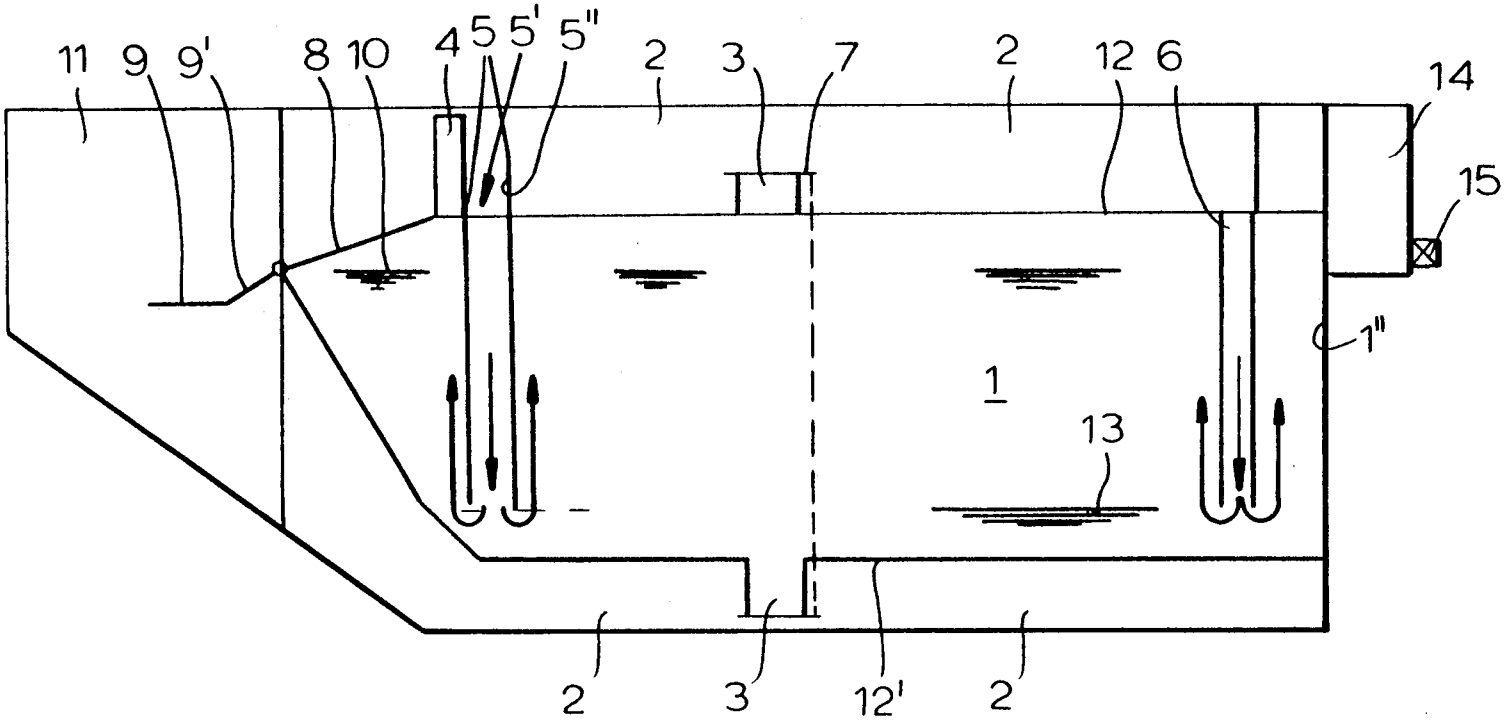
FIG. 1 is a longitudinal section through a vessel for the takeup of light liquid located on the water surface.
Figure 2:
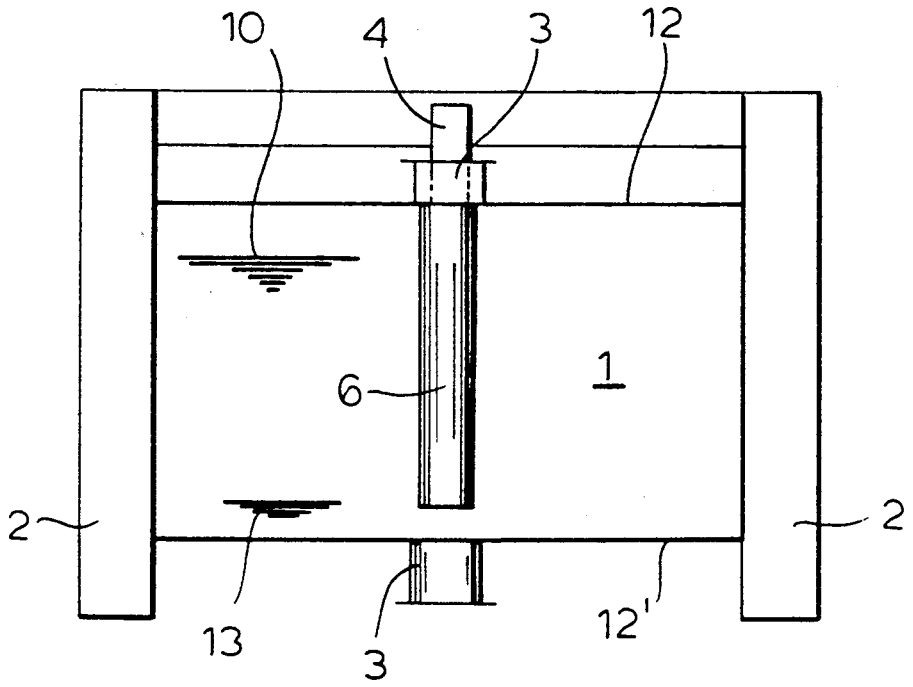
FIG. 2 is a cross-section through the vessel according to FIG. 1.
Figure 3:
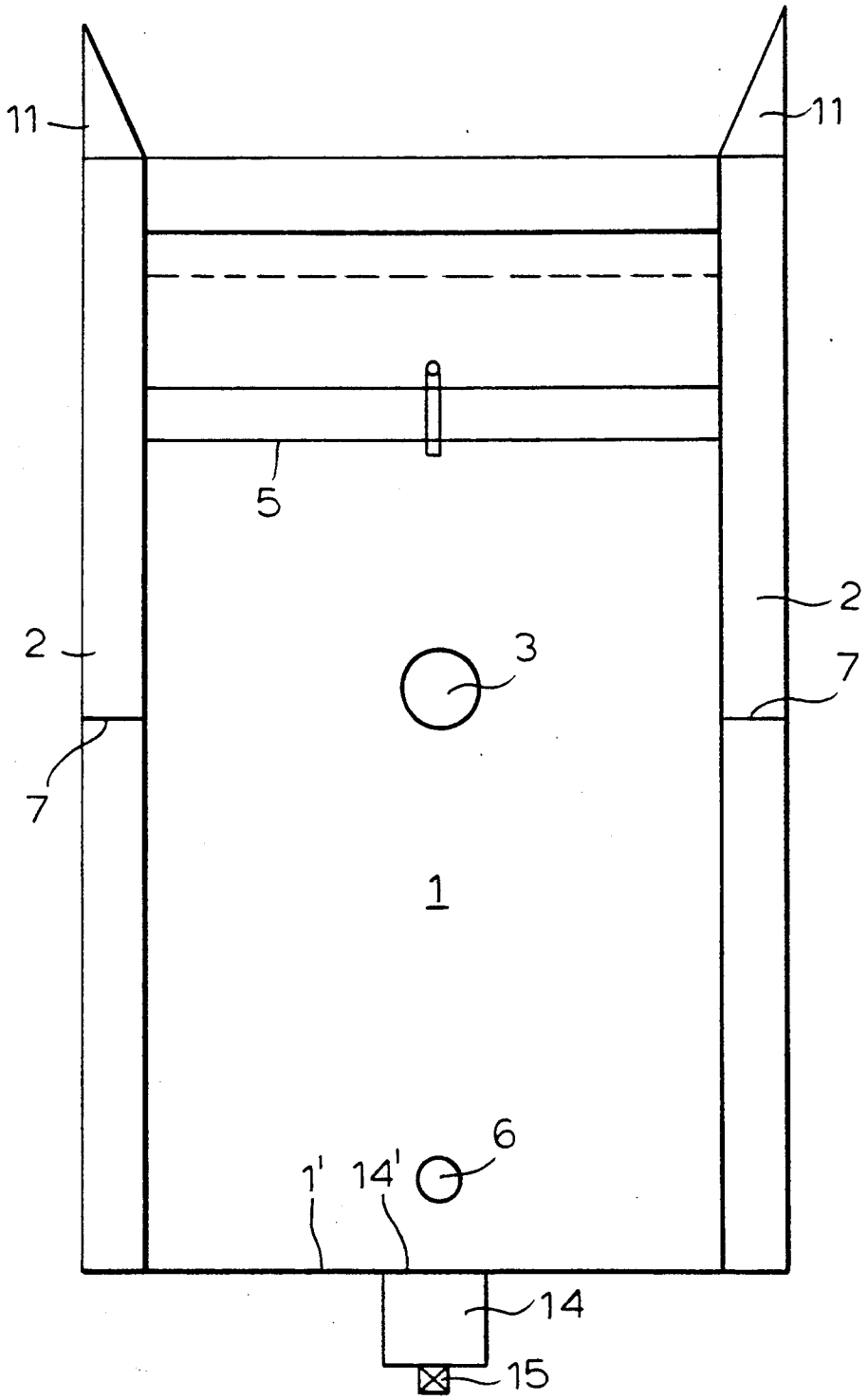
FIG. 3 is a top view of the vessel shown in FIGS. 1 and 2.

The vessel shown in FIGS. 1, 2 and 3 for the takeup of light liquid on the water surface is rectangularly formed in the top view (FIG. 3) and has air-filled cavities 2 on both sides which make the vessel buoyant. The cavities can be flooded with water in order to be able to adjust the draught of the vessel. A corresponding water evacuation is also possible.

The cavities 2 are located in box-like structural members which are divided into three compartments by partitions 7, respectively. The inner wall of the front compartment extends angularly outwardly so that a knife-edge-like front part 11 is formed. The knife-edge-like front parts 11 on both sides of project forwardly beyond the remaining portion of the vessel. Accordingly, upon forward movement of the vessel the light liquid floating on the water is entrapped in the room between the two front parts 11.

A receiving room 1 for the light liquid which has to be taken up is located in the interior of the vessel, i.e. between the two box-like structural members containing the cavities 2. This receiving room is located within an approximately box-like member which is restricted by the box-like members containing the cavities 2 on its both sides. Furthermore, this member has a bottom 12' and a cover 12.

A light liquid receiving means is located in the front portion of the vessel. This light liquid receiving means has an inclined plane 8 which is formed by the front portion of the cover of the light liquid receiving room 1 and a forwardly joining knife-like member 9 grasping under the light liquid layer which has to be taken up. This knife-like or blade-like member is pivotally supported at the lowest point of the inclined plane 8, i.e. the foremost point of the light liquid receiving room 1, and can thus be adjusted with respect to the respective thickness of the light liquid layer which has to be taken up. In the shown embodiment the knife-like member 9 is angularly formed in its rearward portion 9' in the extension of the inclined plane, while the forward portion extends horizontally.

Behind the inclined plane 8 the cover 12 of the light liquid receiving room 1 extends horizontally up to the end of the vessel. A ventilation tube 4 and behind the same a light liquid inlet 5' are located shortly behind the inclined plane. The light liquid inlet is downwardly joined by a dip well 5 which is formed by two dip walls located one behind the other and extending downwardly into the light liquid receiving room 1.

These dip walls extend to a point shortly in front of the bottom of the light liquid receiving room. The rear dip wall extends upwardly beyond the cover of the light liquid receiving room and forms together with the cover, the side walls of the box-like members forming the cavities 2 and a rear boundary wall 7'' a light liquid retaining trough. A dip tube 6 extends downwardly into the light liquid receiving room to the level of the dip well in the rear portion of this trough.

Furthermore, the light liquid receiving room 1 has in its bottom an opening 3 communicating with the outside water. An opening 3 is provided at the cover 12 and functions as pressure balance opening.

A suction container 14 having a suitable suction connection 15 is located behind the light liquid receiving room 1. The suction container 14 and the light liquid receiving room 1 are connected with one another by means of an overflow wall 14'' (FIG. 3) over which the light liquid flows into the suction container 14. Since the suction container is disposed at the level of the outside water and since the overflow edge of the wall 14 is located slightly below the level of the outside water no water can enter the suction container.

The vessel operates in the following manner.

At the beginning of the operation the draught or the outside water level is adjusted such that it is exactly at the height of the fulcrum of the knife-like member 9. This is realized by filling the cavities 2 with water. Accordingly, also the water level within the light liquid receiving room 1 adjusts itself at this level, as shown at 10 in FIG. 1. Then, the vessel moves in the runout light liquid layer floating on the water. The knife-like member 9 is adjusted such that it grasps under the light liquid layer with as little water as possible. By the movement of the vessel the light liquid layer is banked-up between the two knife-edge-like front parts 11, wherein the layer successively flows over the knife-like member 9 to the inclined plane 8 and to the light liquid inlet. The light liquid-water-mixture enters the dip well 5, wherein the light liquid displaces the water in the dip well so far until the light liquid column has reached the lower end of the dip well. Then, the light liquid ascends in the light liquid receiving room, whereby the water therein is displaced through the opening 3 in the bottom 12'.

If a high amount of mixture is present, a part thereof flows over the upper edge of the upwardly extended rear dip wall 5' into the light liquid retaining trough and from there over the dip tube 6 located the rear end thereof into the light liquid receiving room 1. Upon a continuous light liquid flow the light liquid flows from the light liquid receiving room over the overflow wall 14'' into the suction container 14 and can be pumped off therefrom.

The displaced water level at the lower edge of the dip well and the dip tube is shown at 13 in FIG. 1.

Figure 4:
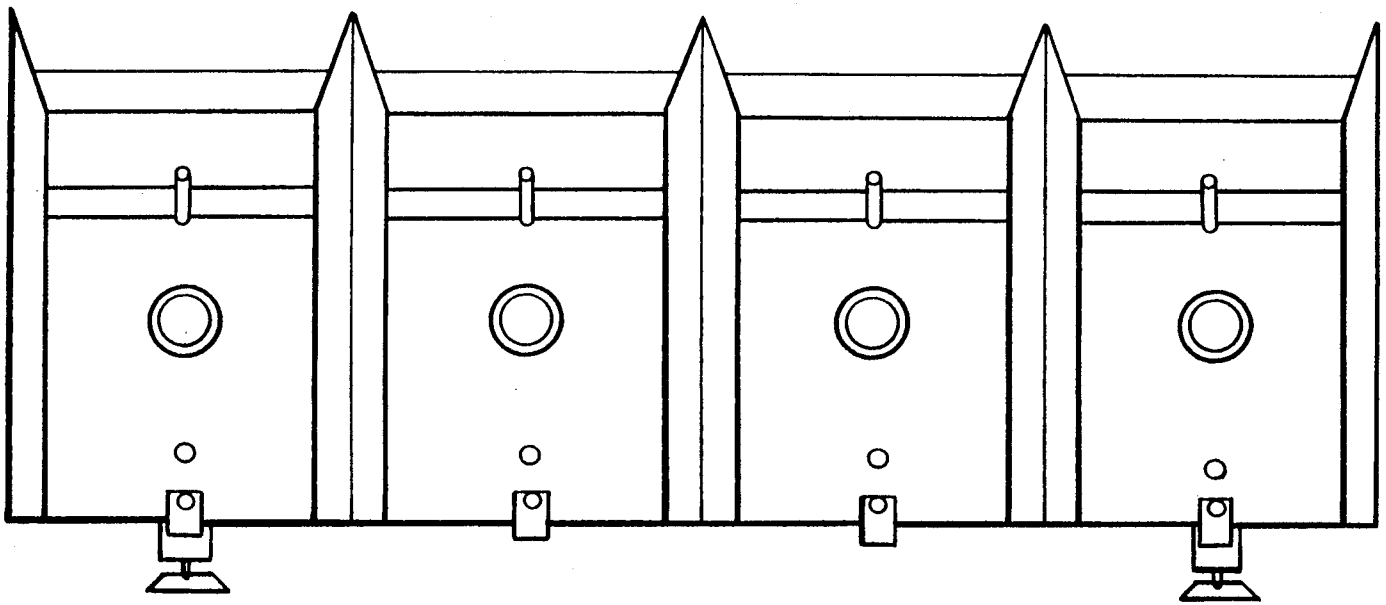
FIG. 4, is a top view of four connected vessel.

FIG. 4 shows four laterally coupled vessels of the above-described kind. These can be used, for example, as barrier on a river.

Figure 5:
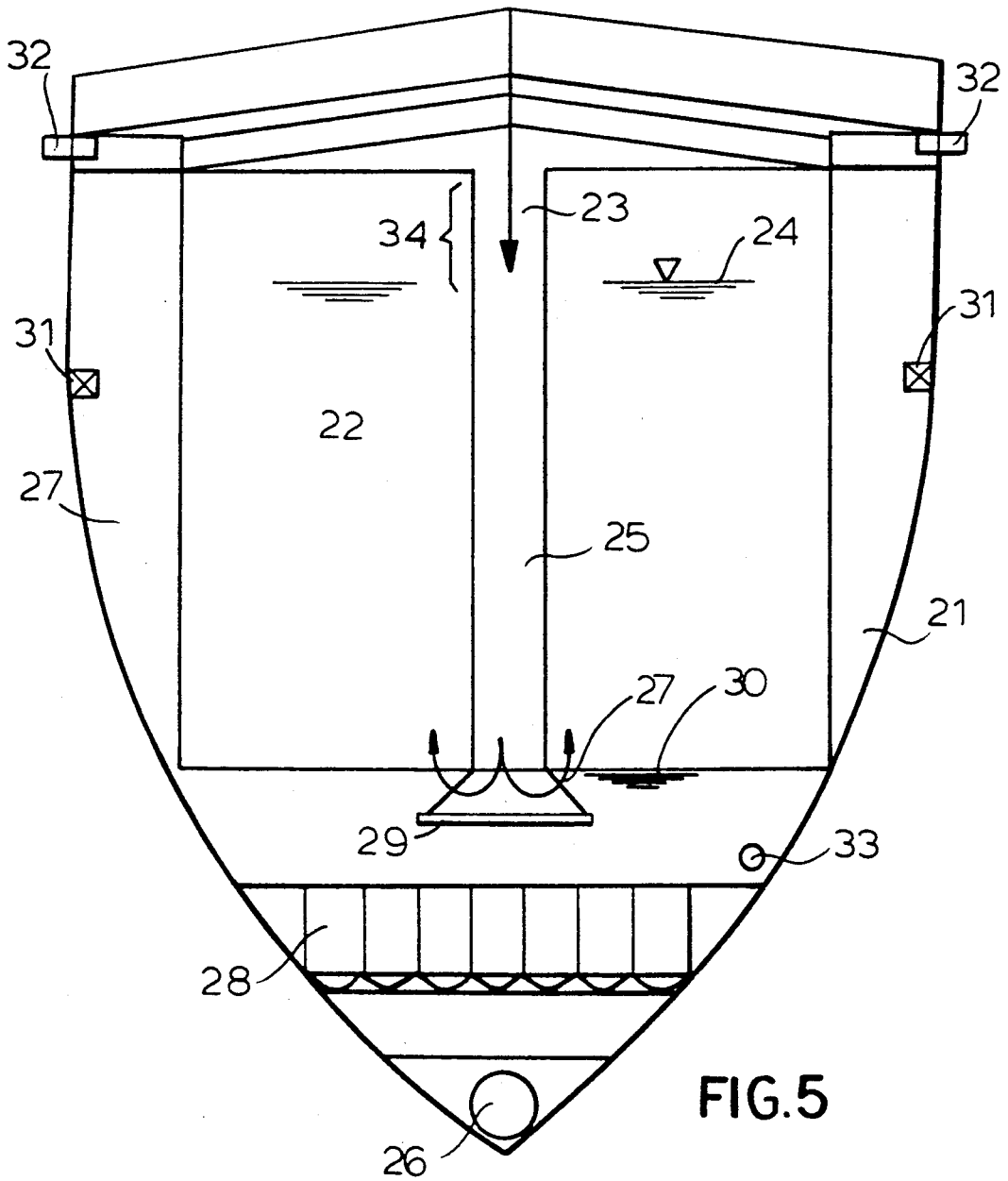
FIG. 5 is a cross-section through a mother vessel for the vessel shown in FIGS. 1 to 4.
Figure 6:
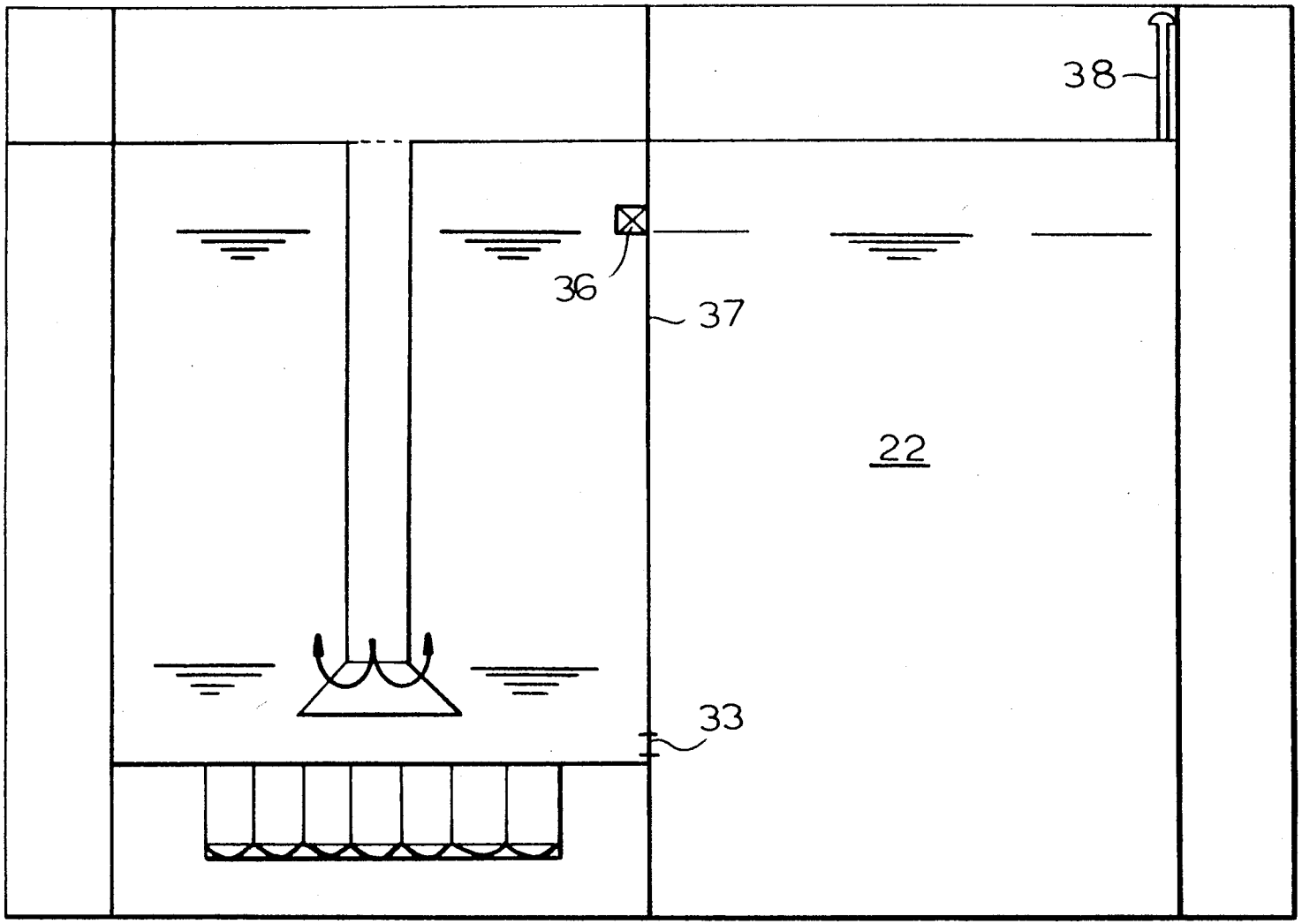
FIG. 6 is a longitudinal section through the mother vessel of FIG. 5.

FIGS. 5 and 6 show a mother vessel serving for takeup of the light liquid pumped off from the above-described vessel. The motor vessel has also cavities 21 which make the vessel buoyant and with which its draught can be regulated. However, in contrast to the above-described vessel the mother vessel has a customary body. A light liquid receiving room 22 is located in its interior into which the pumped-off light liquid is pumped by means of an inlet in the form of a dip tube 25. Also in this case the light liquid receiving room 22 communicates with the outside water through an opening 26 so that the water level in the light liquid receiving room is downwardly displaced by the introduced oil. The water level at the beginning of the light liquid takeup is shown at 24. The possible light liquid column over the water level is shown at 34. The displaced water level at the lower end of the dip tube is shown at 30. A distributor member 29 connected to the overflow edge 27 of the dip tube is disposed at this lower end of the dip tube.

A fine separation stage 28 is disposed within the light liquid receiving room 22 below the dip tube. This fine separation stage consists of a separation chamber system with inclined planes and heavy liquid passage openings at the bottom.

Furthermore, in FIG. 5 pump inlet connections 32, water inlet/outlet valves 31 for the filling of the cavities 21 and connections 33 are shown. The longitudinal section of FIG. 6 shows a partition 37 in the light liquid receiving room which has connections 33 and 36. Furthermore, a ventilation 38 is provided for the light liquid receiving room 22.

Light liquid pumped off from the vessel flows over the inlet 23 and the dip tube 25 into the light liquid receiving room 22. Here, an additional separation between light liquid and still entrained water occurs. The light liquid still adhering to the water is separated from the heavy liquid in the following fine separation stage 28. The light liquid having a relatively high degree of purity which then collects in the light liquid receiving room can thereafter be disposed or again used in a harbour towards which the mother vessel stirs.

Figure 7A:
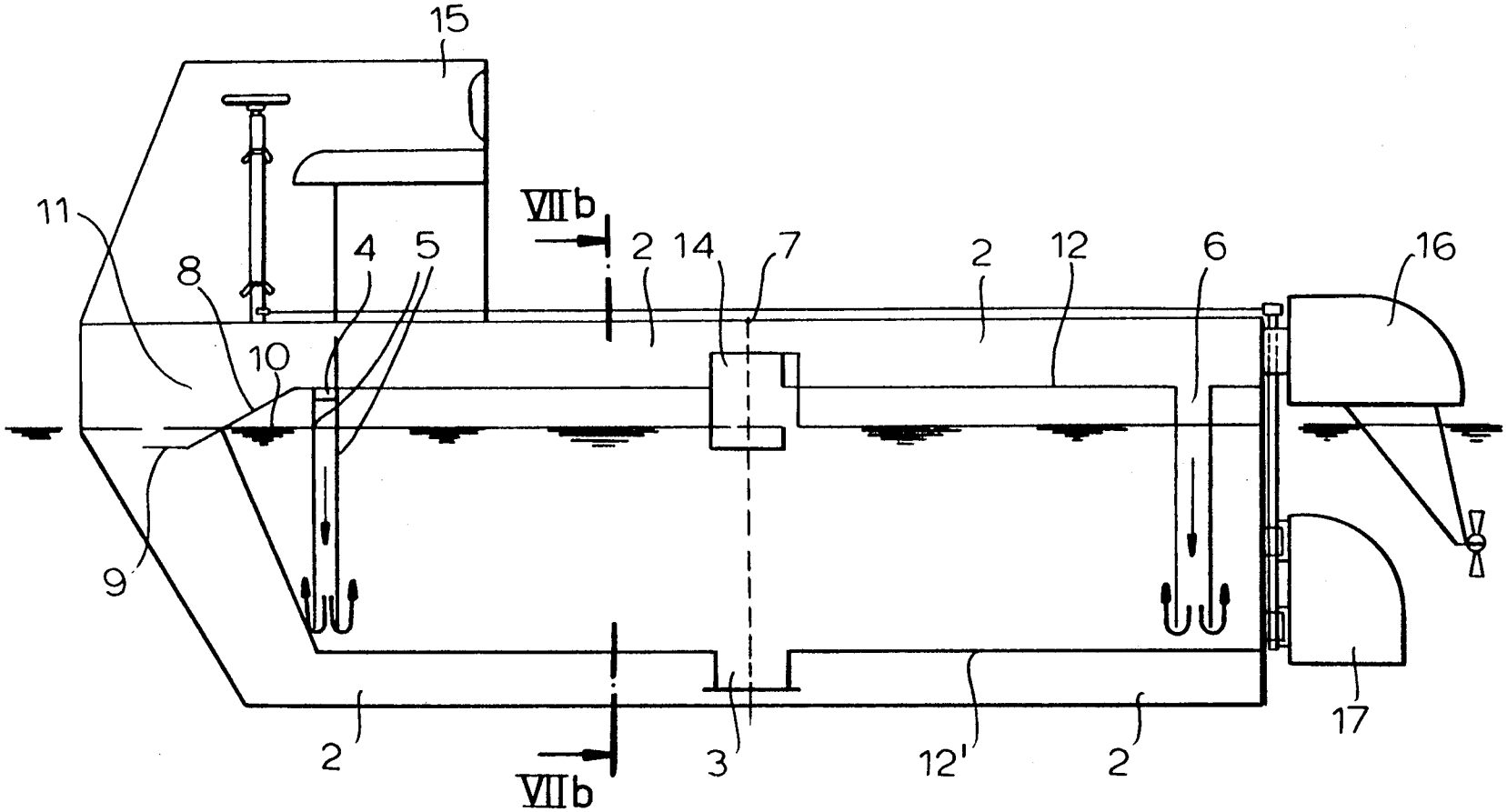
FIG. 7 is a longitudinal section taken along line A—A in FIG. 7 and a top view of a further embodiment of a vessel.

FIGS. 7*a, b* and *c* show a further embodiment of a vessel for the takeup of light liquid on the water surface in a longitudinal section, a section along line A—A and in a top view respectively. This embodiment substantially corresponds to the embodiment shown in FIGS. 1 to 3 so that it is desisted from repeating the description of corresponding members. In the following only the deviating members or additional members are described.

As the figures show, the light liquid suction room 14 is not located at the end of the vessel but about in the middle of the same. It is exactly located over the pressure balance opening 3 provided in the bottom 12' of the light liquid receiving room 1. The light liquid suction room 14 is downwardly open and has a lateral downwardly directed opening which is exactly directed to the water level 10 within the light liquid receiving room 1. The arrangement of the light liquid suction room approximately in the center of the vessel has the advantage that the suction process is not influenced by the propulsion of the vessel and that is always sucked off in the middle of the same with fluctuating water level.

Figure 7B:
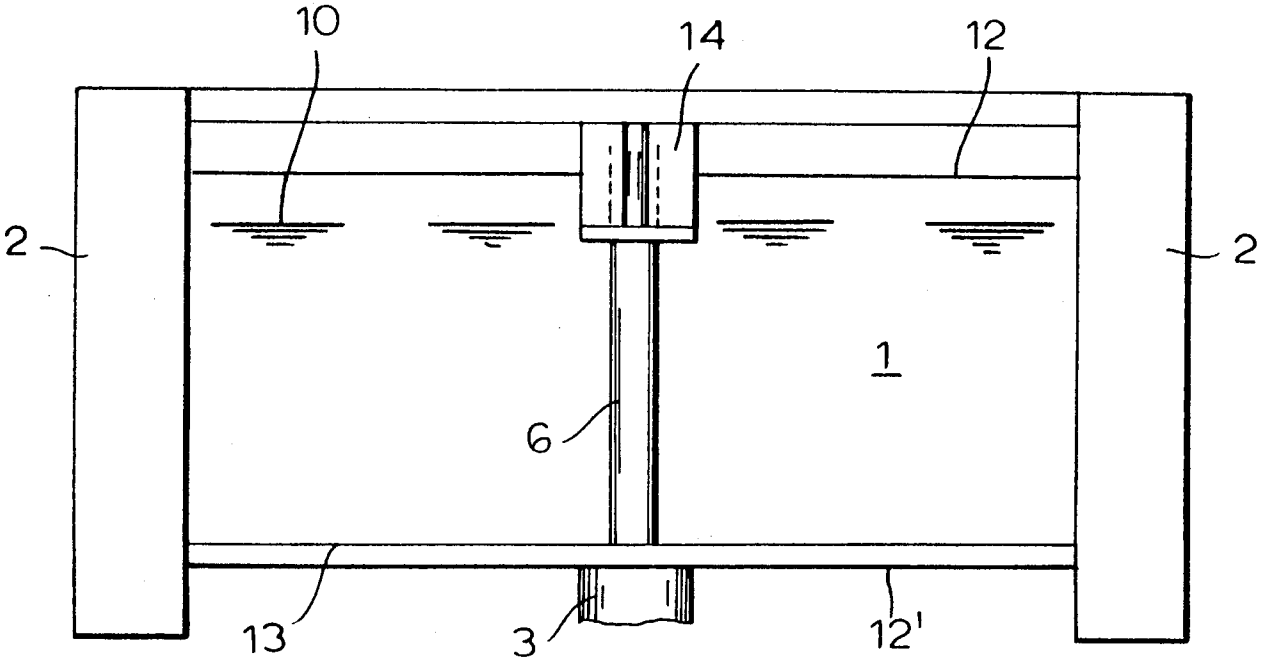
Figure 7C:
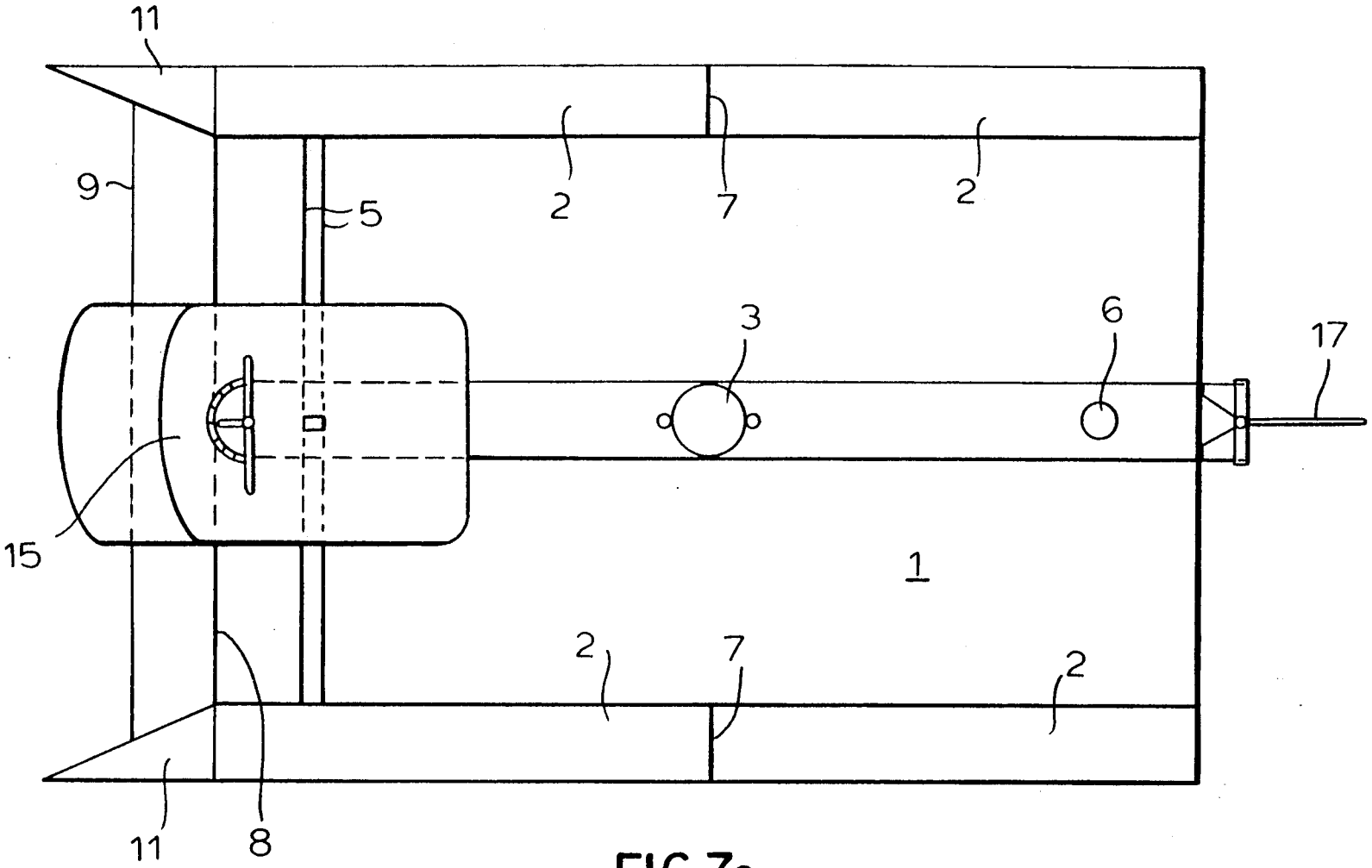

Furthermore, FIG. 7 shows a driver cabin 15 which is not shown in the preceding figures. In this cabin an operator of the vessels its who operates the rudder 17 and an outboard motor 16.

I claim:

1. An apparatus for separating a light liquid layer of relatively low density from a surface of a body of water as a second liquid of relatively high density, comprising:

a vessel;

a balance means on said vessel receiving and discharging water for adjusting a draft of the vessel for a successive takeup of a light liquid layer floating on a surface of an outer water at a level of said surface;

skimmer means for guiding said light liquid layer into said vessel from outside upon the movement of the vessel;

a storage tank on the vessel and formed with an interior for separating said light liquid layer from water and provided with:

a top formed above said level and having a front surface extending angularly downwardly and outwardly toward said skimmer means, said front surface terminating substantially at said level of the surface and operatively connected with said skimmer means, at least one inlet formed on said top and spaced inwardly from said front surface, said inlet opening downwardly into said interior and being in flow communication with said front surface, at least one dip well in flow communication with said inlet and extending downwardly from said inlet in said interior and terminating at another level lower than said level of the surface, and means forming a flow opening below said other level for free flow of the outer water in and outer of said interior, said balance means adjusting the draft so that said tank is filled with the outer water substantially at said level of the surface at the beginning of said takeup, said light liquid layer displacing the outer water in said tank downwardly to said outer level which accumulating in said interior substantially up to said level of said surface of the outer water upon floating in from said dip tube; and collecting means in free flow communication with said tank for collecting said light layer upon separation in said tank.

2. The apparatus defined in claim 1 wherein said skimmer means includes a knife-like element provided with an outward surface extending beneath said light liquid layer in the outside water and an inward surface extending angularly upwardly and inwardly from said outer surface for directing a mixture of the light liquid layer and water along said front surface inside the vessel, said inner surface being adapted to terminate substantially at said level of said surface of the outer water and pivotally mounted on said front surface of said tank thereby guiding said light liquid layer floated freely therealong into said inlet.

3. The apparatus defined in claim 2 wherein said inner surface of said knife-like element acts as a fulcrum and lies substantially at the level of the surface of the outer water.

4. The apparatus defined in claim 1 wherein said collecting means includes a suction room, said tank being formed with an overflow wall having an edge substantially aligned with said level of the surface of said outer water and defining an entrance of said light liquid layer from said tank into said suction room upon exceeding of said level of the surface in said tank.

5. The apparatus defined in claim 1 wherein said level of the surface is adapted to be at level corresponding to 85% of a length of said dip tube.

6. The apparatus defined in claim 1 wherein said balance means includes a pair of longitudinal sides of the vessel formed respectively with cavities receiving the outer water, said skimmer means communicating with said tank being located between said sides.

7. The apparatus defined in claim 6 wherein said sides project outwardly beyond said skimmer means, said sides being formed with respective inner front lateral surfaces converging inwardly toward one another.

8. The apparatus defined in claim 6 wherein said sides extend upwardly above said level of the surface of the outer water forming thereby a light liquid retaining trough extending along and above said tank, said trough housing said inlet communicating with said dip well.

9. The apparatus defined in claim 8, further comprising a dip tube in flow communication with said retaining trough, said dip tube extending inwardly into said tank and spaced inwardly from said dip well communicating with said inlet.

10. The apparatus defined in claim 9 wherein said dip well extends across said tank and is formed with a rear wall extending upwardly over said inlet.

11. An apparatus for separating a light liquid layer of relatively low density from a surface a body of water as a second liquid of relatively high density, comprising:

a vessel;

a vessel balance means on said vessel receiving means discharging water for adjusting a draft of the vessel for a successive takeup of a light liquid layer floating on a surface of an outer water;

vessel skimmer means for guiding said light liquid layer into said vessel from outside upon the movement of the vessel, said skimmer means including a knife-like element provided with an outward surface extending beneath said light liquid layer in the outside water and an inward surface extending angularly upwardly and inwardly from said outer surface for directing the light liquid layer inside the vessel;

a vessel storage tank on said vessel and formed with an interior for separating said light liquid layer from the outside water and provided with:

at least on vessel inlet spaced inwardly from said outer surface and formed on said tank above said surface of the outer water and opening downwardly into said interior, said inner surface being adapted to terminate substantially at a level of said surface of the outer water and operatively connected with said tank thereby guiding said light liquid layer floated freely therealong into said inlet, at least one vessel dip well in flow communication with said inlet and extending downwardly from said inlet in said interior and terminating at another level lower than said level of the surface, and means forming a vessel flow opening below said other level for free flow of the outer water in and out of said interior, said balance means adjusting the draft so that said tank is filled with the outer water substantially at said level of the surface at the beginning of said takeup, said light liquid layer displacing the outer water in said tank downwardly to said other level while accumulating in said interior upon floating in from said dip tube substantially up to said level of said surface of the outer water;

vessel collecting means in free flow communication with said tank for collecting said light liquid upon separation in said tank; and a mother vessel receiving said light liquid from said vessel collecting means and comprising:

at least one receiving room, conveying means in flow communication with said vessel collecting means for conveying said light liquid layer from said collecting means, said conveying means including at least one dip pipe opening into said receiving room and extending downwardly at a respective level lower than said level of the surface, fine separating means for final separating of said light liquid mounted in said receiving room below said dip pipe, and means forming an aperture in a bottom of said receiving room below said fine separating means for free flow of the outer water in and out of said room, said receiving room being filled with the outer water up to said level of the surface of the outer water at beginning of said takeup, said light liquid layer displacing the outer water through said separating means and said aperture and filling said receiving room at a level higher than said level of the surface.

12. The apparatus defined in claim 11 wherein said separating means includes a plurality of passages opening at said bottom of the receiving room and a separation chamber system having inclined planes.

13. The apparatus defined in claim 11 wherein said collecting means is a suction room located substantially in a middle of said receiving room.

* * * * *